US005355700A

United States Patent [19]

Suzuki

[11] Patent Number: 5,355,700

[45] Date of Patent: Oct. 18, 1994

[54] WINDOW-LOCK AND LEVER-TYPE LOCK

[75] Inventor: Shoji Suzuki, Fuchu, Japan

[73] Assignee: Suzusho Trading Co., Tokyo, Japan

[21] Appl. No.: 214,029

[22] Filed: Mar. 16, 1994

Related U.S. Application Data

[63] Continuation of Ser. No. 997,542, Dec. 28, 1992, abandoned.

[30] Foreign Application Priority Data

Dec. 31, 1991 [JP] Japan ..... 3-113575

[51] Int. Cl.[5] ..... E05B 65/08

[52] U.S. Cl. ..... 70/89; 70/214; 70/DIG. 31

[58] Field of Search ..... 70/213, 90, 89, 138, 70/214, DIG. 31, 209, 95, 99, 51, 210

[56] References Cited

U.S. PATENT DOCUMENTS

| | | | |
|---|---|---|---|
| 2,190,205 | 2/1940 | Birman | 70/90 |
| 2,262,946 | 11/1941 | Kistner | 70/90 |
| 2,613,525 | 10/1952 | Holmsten | 70/89 |
| 3,006,180 | 10/1961 | Walston | 70/213 |
| 3,107,513 | 10/1963 | Walston | 70/213 |
| 3,667,263 | 6/1972 | Rogers | 70/89 |
| 4,063,766 | 12/1977 | Granberg | 292/242 |
| 4,763,497 | 8/1988 | Nakai . | |

FOREIGN PATENT DOCUMENTS

| | | |
|---|---|---|
| 49156/90 | 5/1990 | Australia . |
| 759232 | 1/1934 | France . |
| 1411852 | of 1965 | France . |
| 452295 | 8/1936 | United Kingdom . |
| 2037868A | 7/1980 | United Kingdom . |
| 2223056A | 7/1987 | United Kingdom . |

*Primary Examiner*—Peter M. Cuomo
*Assistant Examiner*—Darnell M. Boucher
*Attorney, Agent, or Firm*—Oliff & Berridge

[57] ABSTRACT

A window having a lock. A catch is provided at one of double sliding windows, and a latch is provided at the other double sliding windows so as to be rotatable and so as to be engageable with the catch. The latch prevents movement of the double sliding windows when the latch is engaged with the catch. A combination padlock prevents rotation of the latch when the latch and the catch are engaged. The combination padlock is locked and unlocked by combinations of positions of a plurality of dials.

12 Claims, 7 Drawing Sheets

WINDOW-LOCK AND LEVER-TYPE LOCK

This is a continuation of application Ser. No. 07/997,542, filed Dec. 28, 1992, now abandoned.

BACKGROUND OF THE INVENTION

1. Field of the Invention

The present invention relates to a window-lock used in sliding windows and sliding doors an to a lever-type lock used for windows, doors and the like which open and close by being rotated.

2. Description of the Related Art

In residences and offices, window-locks and lever-type locks are used for sliding windows and sliding doors and for windows, doors and the like which open and close by being rotated. The conventional window-lock includes a catch, a fixed portion, and a latch. The catch is fixed to the frame of one of the double sliding windows, and the fixed portion is fixed to the frame of the other window. The latch is supported by the fixed portion so as to be freely rotatable, and engages with the catch when rotated by the operation of an operating lever portion. The conventional lever-type lock is provided with a fixed portion, an operating lever portion, an engaging portion, and a latch. The fixed portion is fixed to a window or the like which is opened and closed by being rotated. The engaging portion engages with a window frame or the like by being rotated by operation of the operating lever portion. The latch is supported by the fixed portion so as to be freely rotatable.

With doors or windows such as aluminum sash in which there is glass, if the glass is partially broken in the vicinity of the window-lock or the lever-type lock and the operating lever portion of the latch is rotated, the window-lock or the lever-type lock can be easily unlocked. As a result, prowlers can enter the premises extremely easily. The conventional window-lock and lever-type lock are not sufficiently effective in preventing crime.

SUMMARY OF THE INVENTION

In view of the aforementioned, an object of the present invention is to provide a window-lock and a lever-type lock which are excellent structures in preventing crime.

The present invention is a window-lock having a lock and including a catch provided on one of the double sliding windows; a latch provided rotatably on the other double sliding window and engageable with the catch for preventing movement of the double sliding windows when engaged with the catch; and lock means for preventing rotation of the latch when the latch and the catch are engaged, having a plurality of movable portions, and being locked and unlocked by combinations of respective positions of the plurality of movable portions.

According to the present invention, having the above-described structure, in order to lock the window-lock, with the double sliding windows closed, the latch is rotated so that the latch engages the catch. Then, when the movable portions of the lock means are set at positions corresponding to combinations other than the unlocking combination, the lock means is locked, and rotation of the latch is prevented. On the other hand, by moving the movable portions to positions corresponding to the unlocking combination, the lock means is unlocked, and the latch can be rotated. In this way, locking and unlocking are effected by combinations of the positions of the movable portions. Because the unlocking combination is not easily known by others, the present invention provides an excellent crime-prevention measure having an extremely simple structure. Further, as a key is unnecessary, there is no need to worry about losing the key or storing it. The structure of the present invention permits sliding windows and sliding doors to be locked without trouble.

Further, the present invention is a lever-type lock provided with a window member having a frame portion and a window provided at the frame portion so as to be rotatable. The lever-type lock includes a latch provided at one of the window and the frame portion so as to be rotatable and so as to be engageable with another of the window and the frame portion, and preventing rotation of the window when engaged with the other of the window and the frame portion; and lock means for preventing rotation of the latch when the latch is engaged with the other of the window and the frame portion, having a plurality of movable portions, and being locked and unlocked by combinations of respective positions of the plurality of movable portions.

According to the present invention, having the above-described structure, when the lever-type lock is to be locked, the window is rotated shut. Next, the latch is rotated and is engaged with the other of the window and the frame portion. Then, when the movable portions of the lock means are moved to positions corresponding to the locking combinations, the lock means is locked, and rotation of the latch is prevented. In contrast, when the movable portions are set at the unlocking combination, the latch can be rotated. As described above, an excellent crime prevention effect can be achieved with a very simple structure. Further, because there is no need for a key, there is no need to worry about loss or storage thereof. The present invention, therefore, results in easy, convenient locking of windows and doors.

DESCRIPTION OF THE PREFERRED EMBODIMENTS

Figure 1:
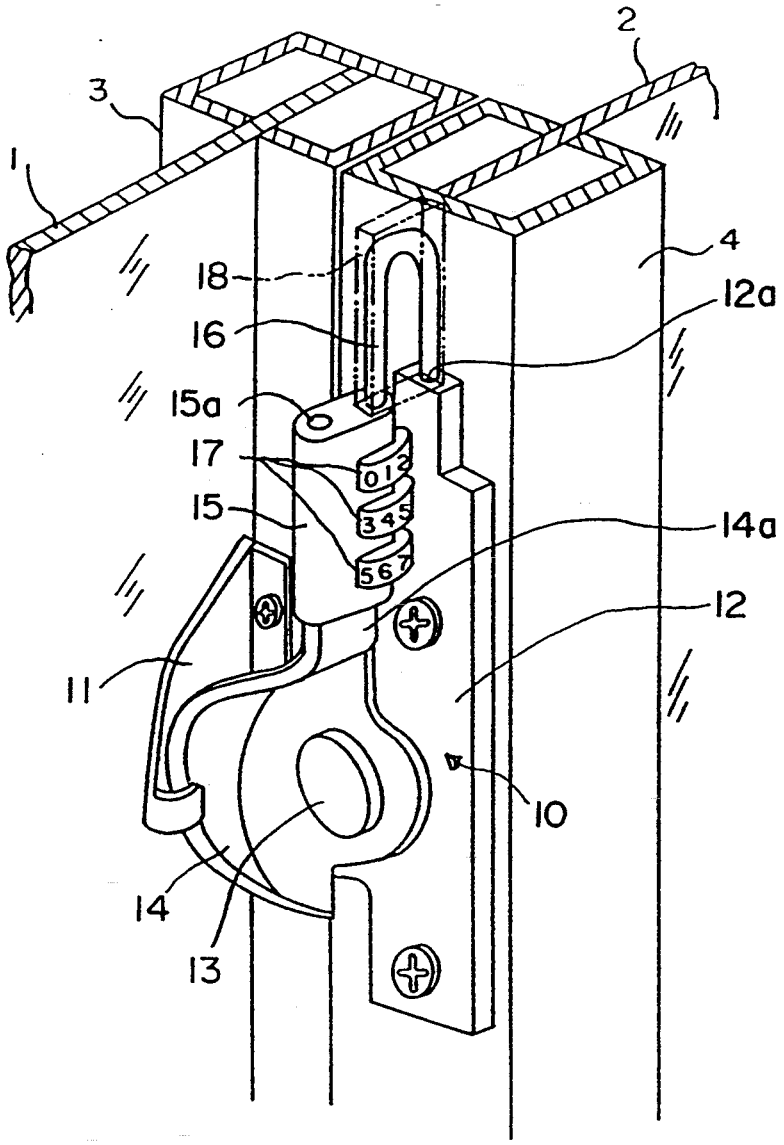
FIG. 1 is a perspective view of a window-lock having a lock, and illustrates an embodiment of the present invention.
Figure 2A:
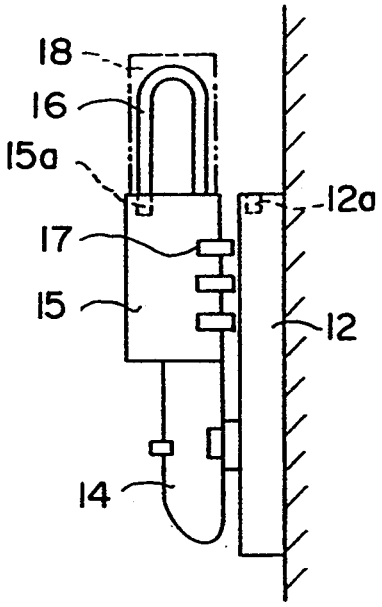
FIG. 2A is an explanatory illustration showing an ordinary state.
Figure 2B:
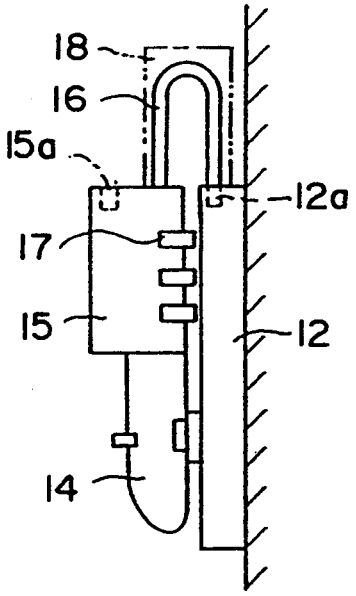
FIG. 2B is an explanatory illustration showing a locked state.

An embodiment of the present invention will be described hereinafter with reference to FIGS. 1 and 2. As illustrated in FIG. 1, a window-locked 10 is formed by a catch 11, a fixed portion 12, and a latch 14. The catch 11 is fixed to a frame 3 of one of double sliding windows 1, 2 such as an aluminum sash. The fixed portion 12 is fixed to a frame 4 of the other of the sliding windows 1, 2 in the same way as the catch 11 is fixed to the frame 3. The latch 14 is axially supported to the fixed portion 12 by a pin 13 so as to rotate freely. The latch 14 is rotated by an operating lever portion 14*a*. The above-described structure is commonly known.

In the present embodiment, a combination padlock 15 is mounted to the operating lever portion 14*a*. An end of a bolt member 16, which serves as a shaft member, is inserted into an engaging hole 12*a* provided in the fixed portion 12. In the combination padlock 15, when the bolt member 16 is rotated an arbitrary angle from a hole 15*a* of the combination padlock 15, the bolt member 16 can be locked. In the present embodiment, even if the bolt member 16 is inserted into the engaging hole 12*a* of the fixed portion 12, the bolt member 16 can be locked by rotating dials 17. The structure of the combination padlock 15 will be described in detail later.

Next, operation of the present embodiment will be described. Usually, the bolt member 16 is released from its locked state by the dials 17 of the combination padlock 15 being rotated. The bolt member 16 is removed from the engaging hole 12*a*, is rotated in the direction of the combination padlock 15, and is inserted into the hole 15*a* of the combination padlock 15 (the state shown in FIG. 2A). After the sliding windows 1, 2 are shut, the operating lever portion 14*a* is rotated so that the latch 14 is made to engage the catch 11. The bolt member 16 is raised, is rotated so as to be above the engaging hole 12*a*, and the end thereof inserted into the engaging hole 12*a* (the state illustrated by FIGS. 1 and 2B). Then, the bolt member 16 is locked by the dials 17 being rotated appropriately. When the sliding windows 1, 2 are to be opened, the dials 17 are rotated to respective numbers set in advance which unlock the bolt member 16, and the locked state of the bolt member 16 is canceled. The bolt member 16 is pulled upward so that the end thereof is removed from the engaging hole 12*a*. If the bolt member 16 is rotated in the direction of the combination padlock 15, the operating lever portion 14*a* can be rotated. In the illustrated embodiment, when the operating lever portion 14*a* is rotated, the bolt member 16 is grasped and rotated. Therefore, a bolt member cover 18 may be placed over the bolt member 16. Further, the operating lever member 14*a* may be extended above the combination padlock 15.

Because the combination padlock 15 is incorporated into the window-lock 10, even if the glass near the window-lock 10 is partially broken, the combination padlock 15 cannot be unlocked and the operating lever portion 14*a* cannot be rotated if the previously set numbers of the dials 17 are not known. Therefore, the present embodiment is an excellent structure for preventing crime. Further, if the numbers of the combination padlock 15 can freely changed, members of the household can create their own combination of numbers so that the combination will not be easily forgotten. Instead of the combination padlock 15, an ordinary lock which is lock and unlocked by a key can be installed on the window-lock. However, using a key results in drawbacks such as storage of the key, loss thereof, and the like. When the combination padlock 15 is used, these drawbacks do not arise because a key is not used. Further, the main body of the combination padlock 15 may be formed integrally with the operating lever portion 14*a*. The main body of the combination padlock 15 may be covered by a cover so that a portion of the dials 17 is exposed.

Next, another embodiment of the present invention will be described with references to FIGS. 3 through 6. A lever-type lock 20 includes a fixed portion 21 and a latch 22 axially supported to the fixed portion 21 so as to be freely rotatable. The fixed portion 21 is fixed to a window 30 which is opened and closed by being rotated. The latch 22 includes an engaging portion 23, which engages with a window frame 31, and an operating lever portion 24, which rotates the latch 22. The above-described structure is commonly known.

In the present embodiment, the combination padlock 15 is formed integrally with the base portion of the operating lever portion 24. An engagement portion 21*a*, which is an engagement groove or hole in which the end of the bolt member 16 of the combination padlock 15 is inserted, is provided in the fixed portion 21. The bolt member cover 18 is attached to the bolt member 16 in order to facilitate operation of the bolt member 16.

Figure 3:
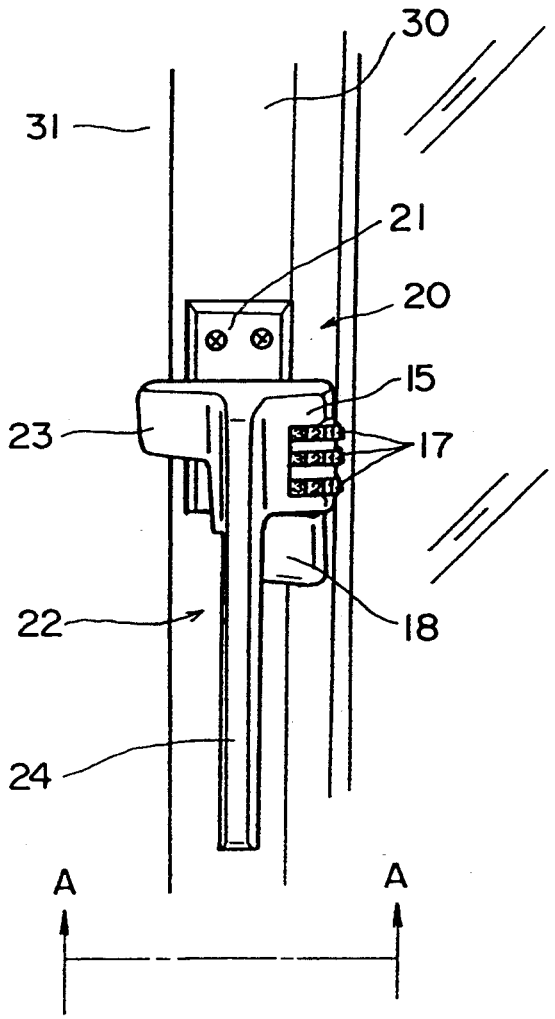
FIG. 3 is a front view of a locked state, and illustrates an embodiment of a lever-type lock of the present invention.
Figure 4A:
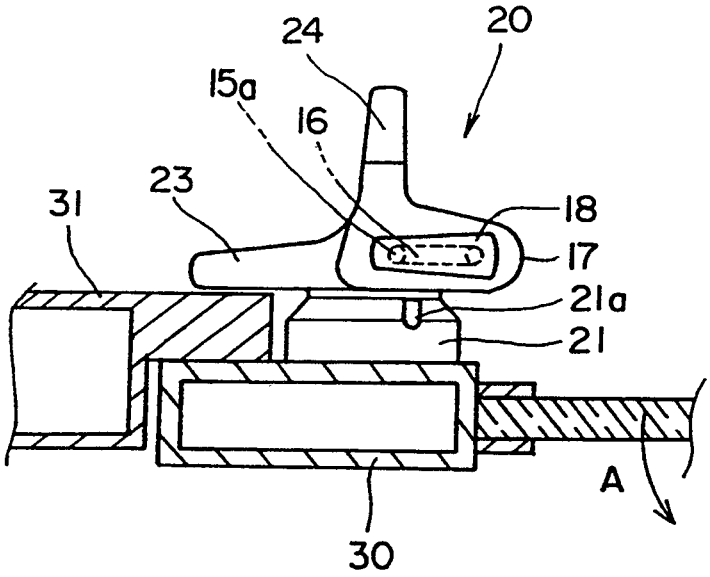
FIG. 4A is a partially sectional view of an ordinary state as seen from the direction of arrow A of FIG. 3.
Figure 4B:
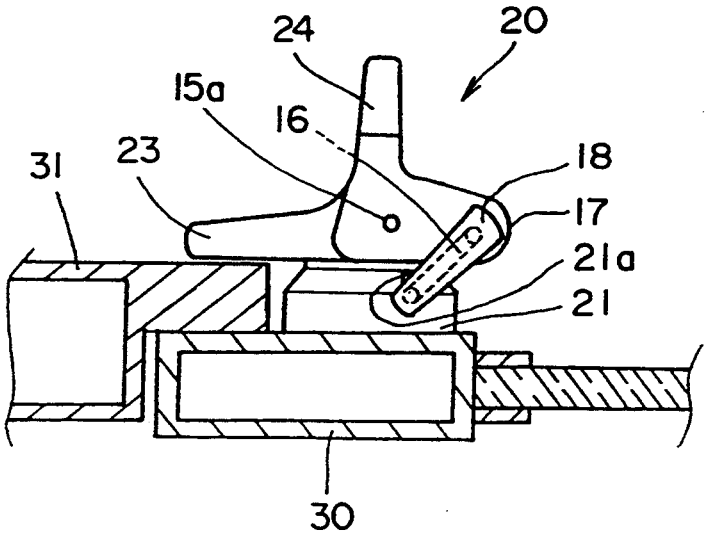
FIG. 4B is a partially sectional view of a locked state as seen from the direction of arrow A of FIG. 3.
Figure 5:
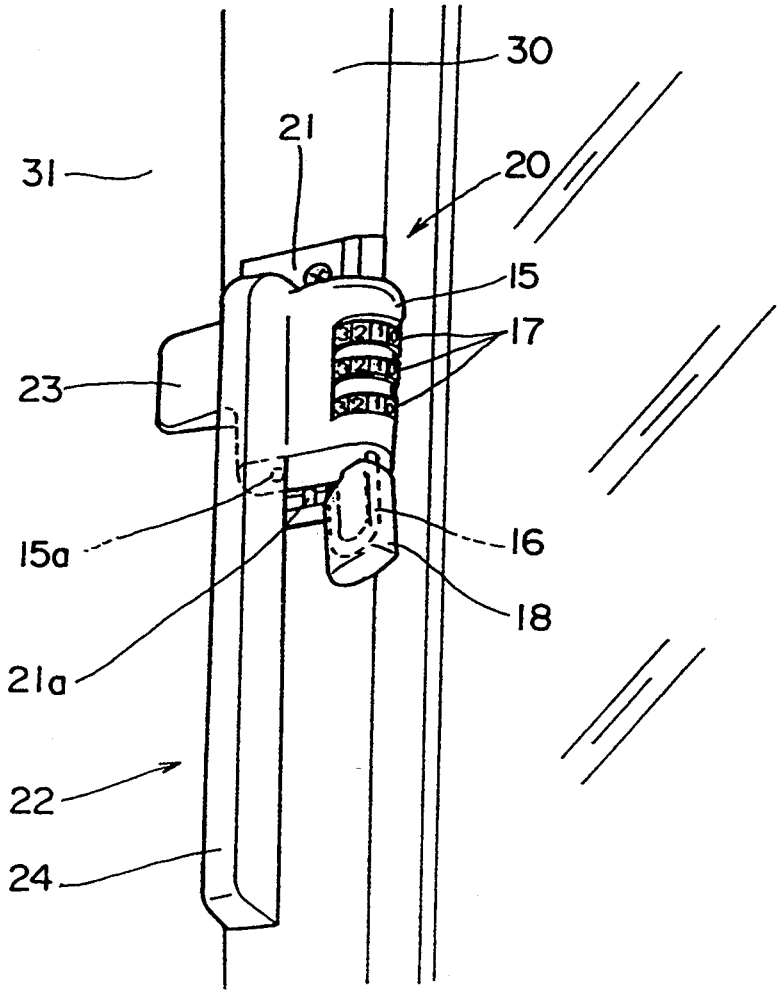
FIG. 5 is a perspective view of a state in which a bolt member is released from its locked state in FIG. 3.
Figure 6:
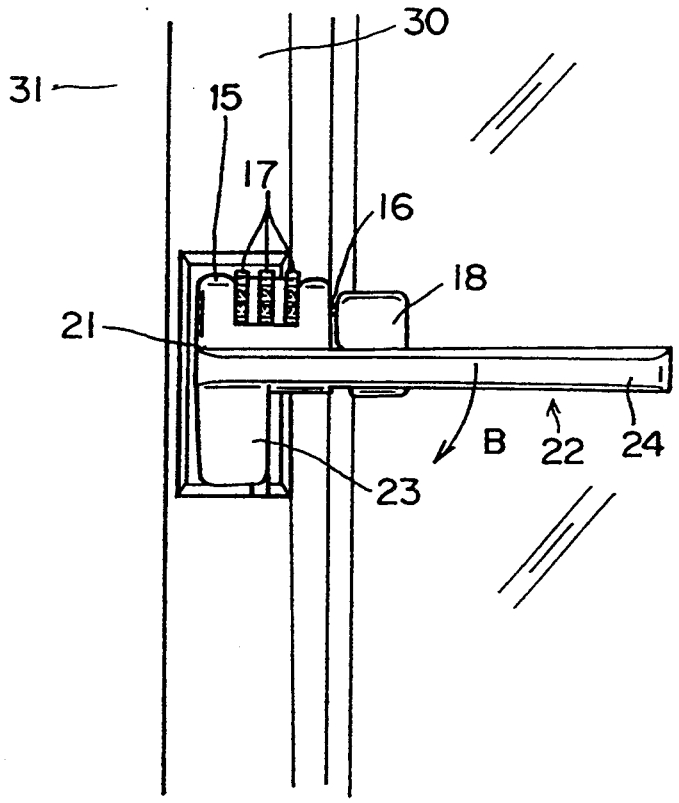
FIG. 6 is a front view of a state in which an operating lever portion is rotated from the state in FIG. 5, and a window is released from its locked state.

Next, operation of the present embodiment will be described. FIG. 5 illustrates a state in which the window 30 is in a state in which it can be opened and closed and the bolt member cover 18 is pulled so that the end of the bolt member 16 is removed from the hole 15*a* of the combination padlock 15. When the window 30 is to be locked, the operating lever portion 24 is rotated from the state shown in FIG. 6 in the direction of arrow B so that the engaging portion 23 engages the window frame 31 as shown in FIGS. 3, 4A, and 4B. Next, the bolt member cover 18 is rotated so that the end of the bolt member 16 corresponds to the engaging portion 21*a* of the fixed portion 21, as shown in FIG. 4B. Thereafter, the bolt member cover 18 is pushed upward so that the end of the bolt member 16 is inserted into the engaging portion 21*a*. When the dials 17 are rotated appropriately, the bolt member 16 is locked. When the window 30 is to be opened, the dials 17 are rotated to respective numbers set in advance which unlock the bolt member 16, and the locked state of the bolt member 16 is canceled. Thereafter, the bolt member 16 is pulled downward so that the end of the bolt member 16 is removed from the engaging portion 21*a*. If the bolt member 16 is rotated in the direction of the combination padlock 15, the operating lever portion 24 can be rotated.

Because the combination padlock 15 is incorporated into the lever-type lock 20, even if the glass near the lever-type lock 20 is partially broken, the operating lever portion 24 cannot be rotated if the previously set numbers of the dials 17 are not known. Accordingly, by incorporating the combination padlock 15 into the lever-type lock 20, the same effects as those of the embodiment in which the combination padlock 15 is installed in the window-lock 10 can be achieved.

Figure 7:
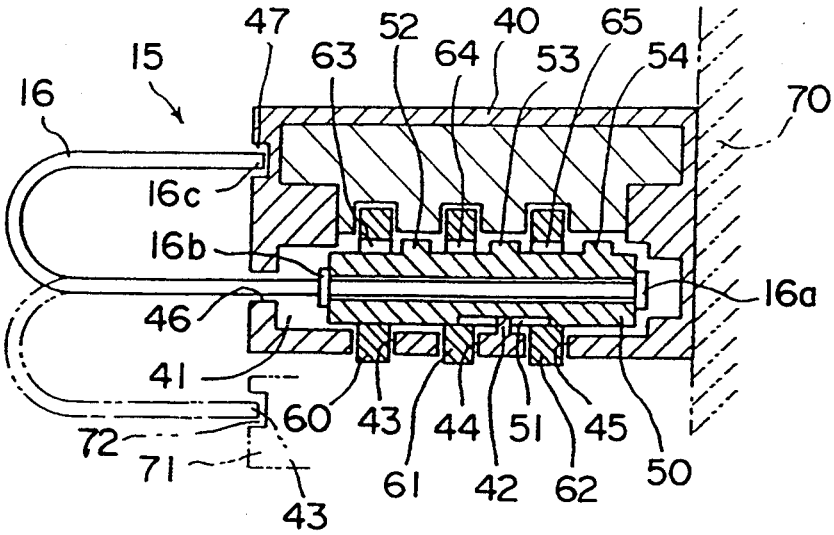
FIG. 7 is a central sectional view illustrating an embodiment of a combination padlock of the present invention.
Figure 8:
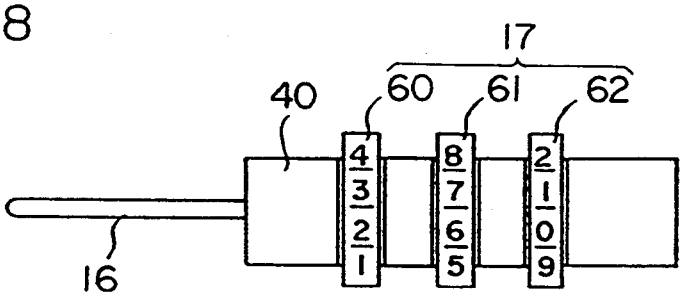
FIG. 8 is a front view of main parts illustrated in FIG. 7.
Figure 9:
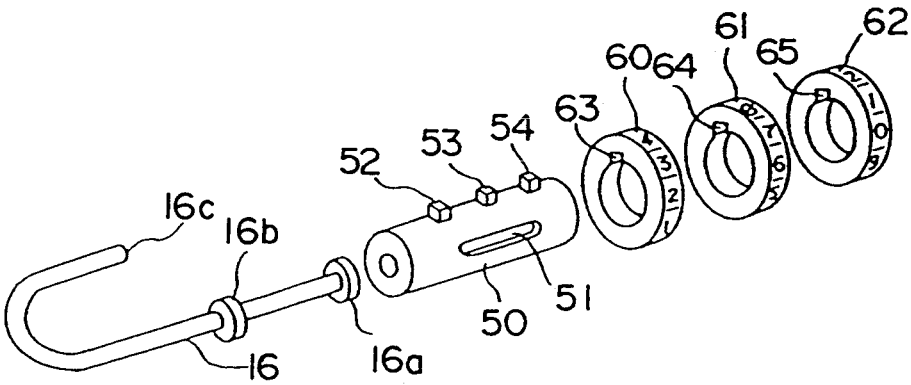
FIG. 9 is an exploded view of the main parts illustrated in FIG. 7.

Next, an embodiment of the combination padlock 15 suitable for the window-lock 10 and the lever-type lock 20 will be described with reference to FIGS. 7 through 9. A pipe member 50 is fitted with play into a cylindrical, hollow portion 41 formed in a main body 40 of the combination padlock 15. The pipe member 50 is slidable along the axial direction thereof. A groove 51 is provided in an outer circumference of the pipe member 50 in the axial direction thereof. A protrusion 42 formed on the main body 40 engages with the groove 51 so that the pipe member 50 cannot rotate. The bolt member 16, which is rod-like and formed as the letter "J", is inserted so as to be freely rotatable in an interior hole of the pipe member 50. Protruding portions 16*a*, 16*b* protrude from the outer circumference of the bolt member 16 at an end portion and an intermediate portion, respectively, of the bolt member 16. The protruding portions 16*a*, 16*b* are disposed so that both end portions of the pipe member 50 in the axial direction thereof are interposed between the protruding portions 16*a*, 16*b*. The protruding portions 16*a*, 16*b* form a fall-out preventing means which keeps the pipe member 50 from falling out. The bolt member 16 is supported by the pipe member 50. Three protruding portions 52, 53, 54 are formed on the outer circumference of the pipe member 50. Three cut-out windows 43, 44, 45 are provided in the main body 40. Three dial rings 60, 61, 62, which serve as a plurality of movable members and correspond to the dials 17 in FIGS. 1 through 6, are disposed so that one portion of the outer circumference of each of the dial rings 60, 61, 62 is exposed at the respective cut-out windows 43, 44, 45. The dial rings 60, 61, 62 are fitted with play around the pipe member 50. The numbers 0 through 9 are engraved in and spaced equally on the respective outer circumference outer circumferences of the dial rings 60, 61, 62 in the circumferential directions thereof. Notch grooves 63, 64, 66 are formed respectively in the interior holes of the dial rings 60, 61, 62 and are shaped such that the protruding portions 52, 53, 54 of the pipe member 50 can pass through the notch grooves 63, 64, 65. The bolt member 16 projects toward the outside from a hole 46 provided in the main body 40. An end portion 16*c*, which is curved into the shape of the letter J, of the bolt member 16 is engageable with a hole 47 (corresponding to the hole 15*a* in FIGS. 1 through 6) provided in the main body 40.

Next, operation of the combination padlock 15 will be described. The exposed portions on the respective outer circumferences of the dial rings 60, 61, 62 are rotated to positions corresponding to the numbers set in advance, i.e., positions at which the notch grooves 63, 64, 65 of the dial rings 60, 61, 62 correspond to the respective protruding portions 52, 53, 54 of the pipe member 50. When the notch grooves 63, 64, 65 are at the positions corresponding to the projecting portions 52, 53, 54 namely when the positions of the dial rings 60, 61, 62 correspond to the appropriate combination, the pipe member 50 becomes movable in the axial direction thereof. Therefore, when the bolt member 16 is pulled, the pipe member 50 is moved therewith, and the protruding portions 52, 53, 54 enter the notch grooves 63, 64, 65. The lock is thereby released. Because the bolt member 16 is inserted in the pipe member 50 so as to be freely rotatable, the bolt member 16 can be turned when the combination padlock 15 is unlocked as described above. In this case, because the protrusion 42 of the main body 40 engages with the groove 51 of the pipe member 50 and the pipe member 50 cannot rotate within the main body 40, the pipe member 50 does not rotate even if the bolt member 16 is rotated as described above. Further, because the protruding portions 52, 53, 54 of the pipe member 50 respectively engage with the notch grooves 63, 64, 65 of the dial rings 60, 61, 62, the dial rings 60, 61, 62 do not rotate even if the bolt member 16 is rotated. Namely, because the positions of the protruding portions 52, 53, 54 in the direction of rotation thereof do not move, the numbers set in advance do not change even if the bolt member 16 is rotated.

On the other hand, when the locked state is released. the bolt member 16 is rotated so that the end portion 16*c* corresponds to the hole 47 in the main body 40. When the bolt member 16 is pushed so that the end portion 16*c* is inserted into the hole 47, the pipe member 50 is moved along with the bolt member 16 so that the protruding portions 52, 53, 54 of the pipe member 50 are offset in the axial direction from the notch grooves 63, 64, 65 of the dial rings 60, 61, 62. Then, the dial rings 60, 61, 62 are rotated appropriately so that the positions of the notch grooves 63, 64, 65 are deviated from the positions of the protruding portions 52, 53, 54. Accordingly, the combination padlock 15 is locked so that even if the bolt member 16 is pulled, the protruding portions 52, 53, 54 of the pipe member 50 hit against the side surfaces of the dial rings 60, 61, 62, and the bolt member 16 cannot be pulled out. Further, even when the end portion 16*c* is not inserted into the hole 47, the combination padlock 15 is locked by pushing the bolt member 16, rotating the dial rings 60, 61, 62 appropriately, and setting the dial rings 60, 61, 62 at locking combinations.

Next, the method of use of the combination padlock 15 of the aforementioned embodiments will be described with reference to FIG. 7. When a member 70 (corresponding to the operating lever member 14*a* in FIG. 1 and the operating lever member 24 in FIGS. 3 through 6) and another member 71 (corresponding to the fixed portion 12 in FIG. 1 and the fixed portion 21 in FIGS. 3 through 6) are locked by the combination padlock 15, the combination padlock 15 is mounted to the member 70, and a hole 72, in which the end portion 16*c* of the bolt member 16 is inserted is provided at the other member 71. (The hole 72 corresponds to the engaging hole 12*a* in FIG. 1 and the engaging portion 21*a* in FIGS. 3 through 6). When the combination padlock 15 is unlocked, the bolt member 16 is rotated so that the end portion 16*c* corresponds to the hole 72 of the other member 71. The bolt member 16 is pushed, and the end portion 16*c* is inserted into the hole 72. Accordingly, by performing the same operations as those effected when the combination padlock 15 is locked, the protruding portions 52, 53, 54 of the pipe member 50 are offset in the axial direction from the notch grooves 63, 64, 65 of the dial rings 60, 61, 62. Therefore, if the dial rings 60, 61, 62 are appropriately rotated, the bolt member 16 is locked. In this way, the bolt member 16 can be locked at arbitrary positions of rotation of the dial wheels 60, 61, 62.

Further, the above embodiments are described with reference to a case in which a combination padlock is used. However, instead of the combination padlock, an electronic lock, which is locked and unlocked by a plurality of movable portions being set at various combinations of positions by operation of a keyboard panel for inputting a security code number, can be used.

What is claimed is:

1. A window-lock having a lock, comprising:

a catch provided on one of double sliding windows;

a latch provided rotatably on another of said double sliding windows and engageable with said catch and preventing movement of said double sliding windows when engaged with said catch;

a lock member being provided on said latch, said lock member having a plurality of movable portions, a shaft member and a lock member engaging portion, and said lock member being locked and unlocked by combinations of respective portions of said plurality of movable portions; and a fixed member being provided on the sliding window on which said latch is provided and having an engaging portion which engages said shaft member, wherein one end portion of said shaft member is provided so as to be selectively engageable with one of said engaging portion and said lock member engaging portion, said shaft member locking said lock member and preventing rotation of said latch when said latch and said catch are engaged and when said one end portion of said shaft member and said engaging portion are engaged, and said shaft member locking said lock member and being immovable when said one end portion of said shaft member and said lock member engaging portion are engaged.

2. A window-lock having a lock according to claim 1, wherein said lock member is a combination padlock.

3. A window-lock having a lock according to claim 1, wherein said latch has an operating lever portion and said lock member is provided at said operating lever portion.

4. A window-lock having a lock according to claim 1, wherein said lock member includes a lock member main body, a cylindrical member, which is movable only in an axial direction of said cylindrical member in an interior of said lock member main body and which has a plurality of protruding portions provided on an outer circumference of said cylindrical member on a straight line parallel to an axis of said cylindrical member, a plurality of movable portions, which are fit on an outer circumference of said cylindrical member so as to be rotatable around the axis of said cylindrical member and which have in inner circumferential portions of said plurality of movable portions notch grooves through which said protruding portions can pass, a shaft member, one end portion of which is inserted through said cylindrical member so that said shaft member is rotatable only around the axis of said cylindrical member with respect to said cylindrical member, and when said notch grooves are aligned along the line on which said protruding portions are provided, said cylindrical member is unlocked so as to be able to move with said shaft member in an axial direction of said cylindrical member, and in all other cases, at least one of said protruding portions abut said plurality of movable portions so that said cylindrical member is locked.

5. A window-lock having a lock according to claim 1, wherein said fixed member axially supports said latch.

6. A window-lock provided for a window having a frame portion and a window member mounted in said frame portion so as to be rotatably opened, comprising:

a latch provided at one of said window member and said frame portion so as to be rotatable and so as to be engageable with another of said window member and said frame portion for preventing rotation of said window member when engaged with said another of said window member and said frame portion;

a lock member being provided at said latch, said lock member having a plurality of movable portions, a shaft member and a lock member engaging portion and said lock member being locked and unlocked by combinations of respective portions of said plurality of movable portions; and a fixed member being provided at the one of said window member and said frame portion at which said latch is provided and having an engaging portion which engages said shaft member, wherein one end portion of said shaft member is provided so as to be selectively engageable with one of said engaging portion and said lock member engaging portion, said shaft member locking said lock member and preventing rotation of said latch when said latch and said catch are engaged and when said one end portion of said shaft member and said engaging portion are engaged, and said shaft member locking said lock member and being immovable when said one end portion of said shaft member and said lock member engaging portion are engaged.

7. A window-lock according to claim 6, wherein said lock member is a combination padlock.

8. A window-lock according to claim 6, wherein said latch has a frame portion engaging portion, said frame portion engaging portion being engageable with said frame portion.

9. A window-lock according to claim 8, wherein said frame portion engaging portion is a flat extension of said latch which extends laterally to engage said another of said window member and said frame portion when said latch is rotated to a closed position.

10. A window-lock according to claim 6, wherein said latch has an operating lever portion, and said lock member is provided in a vicinity of an end portion of said operating lever portion.

11. A window-lock according to claim 6, wherein said lock member includes a lock member main body, a cylindrical member, which is movable only in an axial direction of said cylindrical member in an interior of said lock member main body and which has a plurality of protruding portions provided on an outer circumference of said cylindrical member on a straight line parallel to an axis of said cylindrical member, a plurality of movable portions, which are fit on an outer circumference of said cylindrical member so as to be rotatable around the axis of said cylindrical member and which have in inner circumferential portions of said plurality of movable portions notch grooves through which said protruding portions can pass, a shaft member, one end portion of which is inserted through said cylindrical member so that said shaft member is rotatable only around the axis of said cylindrical member with respect to said cylindrical member, and when said notch grooves are aligned along the line on which said protruding portions are provided, said cylindrical member is unlocked so as to be able to move with said shaft member in an axial direction of said cylinder member, and in all other cases, at least one of said protruding portions abut said plurality of movable portions so that said cylindrical member is locked.

12. A window-lock according to claim 6, wherein said fixed member axially supports said latch.

* * * * *